US009890435B2

(12) United States Patent
Shouji et al.

(10) Patent No.: US 9,890,435 B2
(45) Date of Patent: Feb. 13, 2018

(54) COLD WORK TOOL MATERIAL AND METHOD OF MANUFACTURING COLD WORK TOOL

(71) Applicant: HITACHI METALS, LTD., Tokyo (JP)

(72) Inventors: Tatsuya Shouji, Yasugi (JP); Setsuo Mishima, Yasugi (JP); Toru Taniguchi, Yasugi (JP); Katsufumi Kuroda, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/914,380

(22) PCT Filed: Sep. 2, 2015

(86) PCT No.: PCT/JP2015/074902

§ 371 (c)(1),
(2) Date: Feb. 25, 2016

(87) PCT Pub. No.: WO2016/047396

PCT Pub. Date: Mar. 31, 2016

(65) Prior Publication Data

US 2017/0204486 A1 Jul. 20, 2017

(30) Foreign Application Priority Data

Sep. 26, 2014 (JP) ..... 2014-196035

(51) Int. Cl.

| | |
|---|---|
| ***C21D 1/18*** | (2006.01) |
| ***C22C 38/24*** | (2006.01) |
| ***C22C 38/22*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C21D 9/00*** | (2006.01) |

(52) U.S. Cl.

CPC ..... *C21D 1/18* (2013.01); *C21D 8/0221* (2013.01); *C21D 9/0068* (2013.01); *C22C 38/001* (2013.01); *C22C 38/002* (2013.01); *C22C 38/02* (2013.01); *C22C 38/04* (2013.01); *C22C 38/22* (2013.01); *C22C 38/24* (2013.01); *C21D 2211/004* (2013.01)

(58) Field of Classification Search

CPC ..... C22C 38/22; C22C 38/24; C22C 38/04; C22C 38/02; C22C 38/002; C22C 38/001; C21D 1/18; C21D 8/0221; C21D 9/0068; C21D 2211/004

See application file for complete search history.

(56) References Cited

U.S. PATENT DOCUMENTS

| | | | |
|---|---|---|---|
| 2009/0107587 | A1 | 4/2009 | Shimizu |
| 2012/0225761 | A1 | 9/2012 | Gaspard et al. |

FOREIGN PATENT DOCUMENTS

| | | | | |
|---|---|---|---|---|
| CN | 103403207 | A | 11/2013 | |
| EP | 0378925 | A1 * | 7/1990 | ..... C22C 33/0285 |
| EP | 2679697 | A1 | 1/2014 | |
| JP | 63-49352 | A | 3/1988 | |
| JP | 5-156407 | A | 6/1993 | |
| JP | 2000-73142 | A | 3/2000 | |
| JP | 2001-123247 | A | 5/2001 | |
| JP | 2005-325407 | A | 11/2005 | |
| JP | 2006-193790 | A | 7/2006 | |
| JP | 2007-46139 | A | 2/2007 | |
| JP | 2007-77442 | A | 3/2007 | |
| JP | 2009-215656 | A | 9/2009 | |
| JP | 2012-251189 | A | 12/2012 | |
| JP | 2014-145100 | A | 8/2014 | |

OTHER PUBLICATIONS

"JIS-G-4404 (2006) Alloy Tool Steel Material", JIS Handbook (1) Iron and Steel I, Japanese Standards Association, Jan. 23, 2013, pp. 1652-1663.

Written Opinion for PCT/JP2015/074902 dated Dec. 8, 2015 [PCT/ISA/237].

Communication dated Aug. 21, 2017 from the European Patent Office in counterpart Application No. 15832776.7.

* cited by examiner

*Primary Examiner* — Jessee Roe

(74) *Attorney, Agent, or Firm* — Sughrue Mion, PLLC

(57) ABSTRACT

A cold work tool material has an annealed structure including carbides, and a composition including, in mass %, C: 0.80% to 2.40%, Cr: 5.0% to 15.0%, Mo and W contained alone or in combination in an amount of (Mo+½W): 0.50% to 3.00%, and V: 0.10 to 1.50%, and adjusted such that the material has a martensitic structure by quenching. The material includes a cross sectional region of an annealed structure and a length of 90 μm and a width of 90 μm and including no carbides having a circle equivalent diameter exceeding 5.0 μm. In the cross sectional region, a proportion of a number of carbides B having a circle equivalent diameter of more than 0.1 μm and not more than 0.4 μm to a number of carbides A having a circle equivalent diameter of exceeds 0.1 μm and not more than 2.0 μm is greater than 80.0%.

4 Claims, 4 Drawing Sheets

5μm

5μm

COLD WORK TOOL MATERIAL AND METHOD OF MANUFACTURING COLD WORK TOOL

CROSS REFERENCE TO RELATED APPLICATIONS

This application is a National Stage of International Application No. PCT/JP2015/074902, filed on Sep. 2, 2015 (which claims priority from Japanese Patent Application No. 2014-196035, filed on Sep. 26, 2014), the contents of which are incorporated herein by reference in their entirety.

TECHNICAL FIELD

The present invention relates to a cold work tool material suitable for various kinds of cold work tools such as press dies, forging dies, rolling dies or metal cutting tools. The present invention also relates to a method of manufacturing the cold work tool with use of the cold work tool material.

BACKGROUND ART

Since a cold work tool is used in contact with a hard workpiece, the tool is required to have a sufficient hardness to resist the contact. Conventionally, alloy tool steels of the SKD10 or SKD11 series for example, which are JIS steel grades, have been used for cold work tool material (see Non Patent Literature 1). Furthermore, an alloy tool steel having an improved composition from the above alloy tool steels has been proposed in response to demands for further increased hardness (see Patent Literature 1).

Typically, a cold work tool material is manufactured from a raw material, as a starting material, such as a steel ingot or a bloom which is produced from the ingot. The starting material is subjected to various hot working and heat treatment to form a predetermined steel material, and then the steel material is subjected to an annealing process to produce the cold work tool material. The cold work tool material in the annealed condition having a low hardness is typically supplied to a manufacturer of a cold work tool. The material is machined into a shape of the tool, and thereafter quenched and tempered to adjust its hardness for use. After the adjustment of the hardness, finishing machining is typically conducted. In some cases, quenching and tempering are conducted first for the material in the annealed condition, and then the machining is conducted for the shaping of the tool together with the finishing machining. Here, the term "quenching" refers to an operation where a cold work tool material (or a cold work tool material that has been subjected to machining) is heated to an austenitic phase temperature range and then rapidly cooled to transform it into a martensitic structure. Thus, the cold work tool material has such a composition that can have a martensitic structure by the quenching.

In this connection, it has been known that a hardness of a cold work tool can be improved by controlling a martensitic structure after quenched. For example, techniques for adjusting an amount of retained austenite in a matrix after quenched (see Patent Literature 2), and techniques for adjusting an amount of chromium or molybdenum dissolved in the matrix after quenched (see Patent Literatures 3 and 4) were proposed.

CITATION LIST

Patent Literature

Patent Literature 1: JP-A-05-156407
Patent Literature 2: JP-A-2000-73142

Patent Literature 3: JP-A-2005-325407
Patent Literature 4: JP-A-2014-145100

Non Patent Literature

Non Patent Literature 1: "JIS-G-4404 (2006) Alloy Tool Steel Material", JIS Handbook (1) Iron and Steel I, Japanese Standards Association, Jan. 23, 2013, pages 1652-1663

SUMMARY OF INVENTION

Technical Problem

Indeed the cold work tool materials of Patent Literatures 2 to 4 can have improved hardness after quenched and tempered. However, change of a tempering temperature brought about a low hardness in some cases. Thus, a high hardness was not obtained over a wide range of the tempering temperature. The tempering temperature is determined not only by the hardness of the cold work tool, but also from a viewpoint of a dimensional change during a heat treatment or adjustment of an amount of retained austenite. Hence, it is advantageous for the cold work tool material to obtain of a high hardness over a wide range of the tempering temperature since the tempering temperature can be selected from an extended range.

An objective of the present invention is to provide a cold work tool material for which a high hardness is obtained over a wide range of tempering temperature, and a method of manufacturing a cold work tool with use of the cold work tool material.

Solution to Problem

The present invention provides a cold work tool material used after quenched and tempered. The material has an annealed structure including carbides and has a composition including, in mass %, C: 0.80% to 2.40%, Cr: 5.0% to 15.0%, Mo and W, alone or in combination in an amount of (Mo+½W): 0.50% to 3.00%, and V: 0.10 to 1.50%, and the composition is adjusted such that the material has a martensitic structure by the quenching. In a region of a length of 90 μm and a width of 90 μm including no carbides having a circle equivalent diameter exceeding 5.0 μm, at a cross-section of an annealed structure of the cold work tool material, a proportion of a number of carbides B having a circle equivalent diameter of more than 0.1 μm and not more than 0.4 μm to a number of carbides A having a circle equivalent diameter of more than 0.1 μm and not more than 2.0 μm is greater than 80.0%.

Preferably, a number density of the carbides A is not less than $9.0\times10^5$ per $mm^2$, and a number density of the carbides B is not less than $7.5\times10^5$ per $mm^2$ in the region of a length of 90 μm and a width of 90 μm.

The present invention also provides a method of manufacturing a cold work tool, including a step of quenching and tempering the cold work tool material of the present invention.

Advantageous Effects of Invention

According to the present invention, a high hardness is obtained over a wide range of tempering temperature for the cold work tool material.

DESCRIPTION OF EMBODIMENTS

Figure 1:
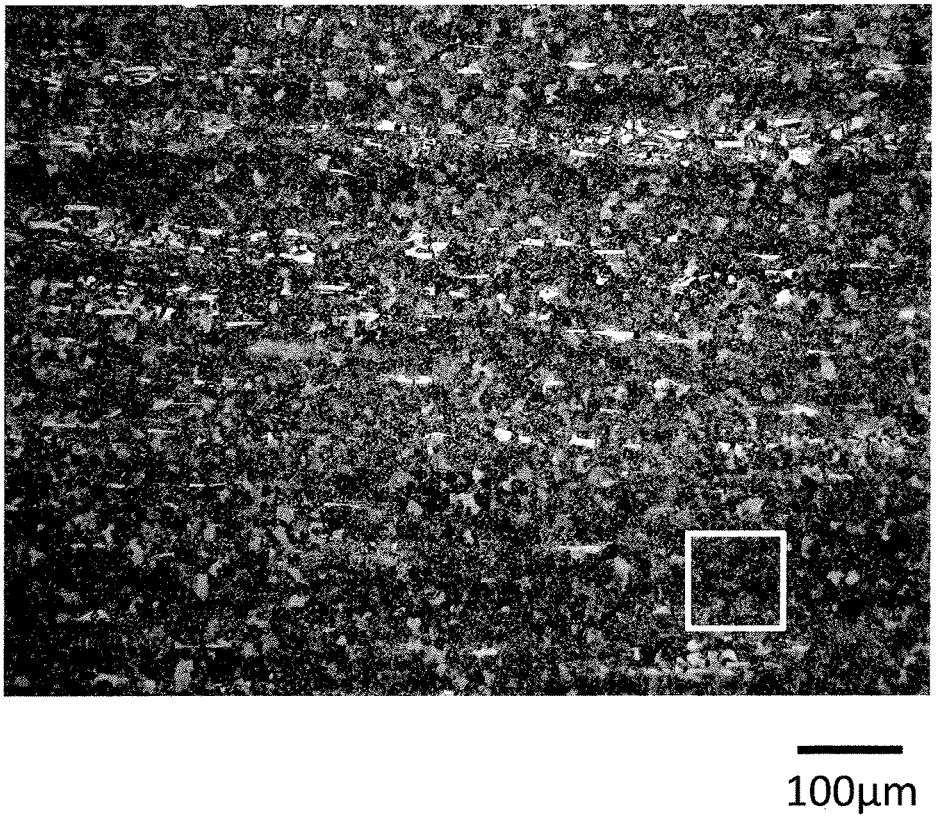
FIG. 1 is an optical microscope photograph illustrating an example of a cross-sectional structure of the cold work tool material of the present invention.

The inventors investigated factors in an annealed structure of a cold work tool material, that influence on a hardness of a quenched and tempered material. As a result, they discovered that, among carbides existing in the annealed structure, a distribution of "solid solution carbides" that are to be solid-solved in a matrix at the time of the subsequent quenching process significantly influences the hardness after quenching and tempering. Then, the inventors found that a high hardness can be obtained over a wide range of a tempering temperature, not at a limited tempering temperature, by means of adjusting the distribution of the solid solution carbides, thereby achieved the present invention. Each component of the present invention is described below.

(1) A cold work tool material used after quenched and tempered, having an annealed structure including carbides:

The term "annealed structure" refers to a structure obtained through an annealing process, and preferably the structure has a softened hardness of around 150 to 230 HBW, for example, in a Brinell hardness. In general, the annealed structure is constituted of a ferrite phase or a ferrite phase with pearlite or cementite ($Fe_3C$). Typically, the annealed structure of a cold work tool material includes carbides composed of carbon bonded with Cr, Mo, W or V or the like. The carbides include "non-solid solution carbides" that are not solid-solved in a matrix during the quenching in the subsequent process, and "solid solution carbides" that are solid-solved in the matrix during the quenching process.

(2) The cold work tool material of the present invention has a composition including, in mass %, C: 0.80% to 2.40%, Cr: 5.0% to 15.0%, Mo and W alone or in combination in an amount of (Mo+½W): 0.50% to 3.00%, and V: 0.10 to 1.50%, and the composition is adjusted such that the material has a martensitic structure by the quenching.

The cold work tool material having an annealed structure is typically produced from a raw material of a steel ingot or a bloom as a starting material, through various hot working and heat treatment to form a predetermined steel material, and then through annealing process on the steel material, thereby finished into a block shape. As described above, a raw material that transforms into a martensitic structure by quenching and tempering is conventionally used for the cold work tool material. The martensitic structure is necessary to establish basic mechanical properties of various cold work tools. As typical cold work tool material, various kinds of cold work tool steels, for example, are known. The Cold work tool steels are generally used in an environment where a surface temperature thereof is not higher than approximately 200° C. A standard steel grades in JIS-G-4404 "alloy tool steels" for example, or other compositions which have been proposed can be applied to these cold work tool steels. In addition, other elements that are not included in the above-described cold work tool steels can also be added as needed.

The effect that "a high hardness can be obtained over a wide range of tempering temperature" (hereunder, referred to as "hardness stability effect") can be achieved if the raw material generates the martensitic structure from the annealed structure through quenching and tempering, and also when the annealed structure satisfies the requirement (3) described later, and preferably the requirement (4). In order to obtain the "hardness stability effect" at a high level, it is effective to determine amounts of carbon and carbide-forming elements Cr, Mo, W or V among the elements for generating the martensitic structure, since the elements contribute to improving an "absolute value" of the hardness of the cold work tool. Specifically, the composition includes, in mass %, C: 0.80% to 2.40%, Cr: 5.0% to 15.0%, Mo and W alone or in combination in an amount of (Mo+½W): 0.50% to 3.00%, and V: 0.10 to 1.50%.

By increasing the absolute value of the hardness of the cold work tool, the "hardness stability effect" acts synergistically therewith, thereby the cold work tool can obtain excellent mechanical properties of both "high hardness" and "stable degree of hardness". Elements constituting the composition of the cold work tool material of the present invention are described below.

C: 0.80 to 2.40 Mass % (Hereunder, Expressed Simply as "%")

C (carbon) is a basic element of a cold work tool material. Carbon partially solid-solves in a matrix to provide a hardness thereto, and partially forms carbides to improve a wear resistance and a galling resistance. Also, solid solved carbon as an interstitial atom is expected to exhibit an I (interstitial atom)-S (substitutional atom) effect (carbon acts as drag resistance for solute atoms, and acts to enhance a strength of the cold work tool), if is added together with a substitutional atom having a high affinity with carbon, such as Cr. However, an excessive addition will cause deterioration of toughness due to an excessive increase in non-solid-solved carbides. Therefore, the carbon content is 0.80 to 2.40%. Preferably, the content is not less than 1.00%, more preferably not less than 1.30%. Furthermore, the content is preferably not more than 2.10%, more preferably not more than 1.80%, further more preferably not more than 1.60%.

Cr: 5.0 to 15.0%

Cr (chromium) is an element that increases hardenability. Further, Cr forms carbides to improve wear resistance. Cr also contributes to improve resistance to temper softening, and is a basic element of a cold work tool material. However, an excessive addition will cause formation of coarse non-solid-solved carbides and lead to a deterioration in toughness. Therefore, the Cr content is 5.0 to 15.0%. The content is preferably not more than 14.0%, more preferably not more than 13.0%. Furthermore, the content is preferably not less than 7.0%, more preferably not less than 9.0%, further more preferably not less than 10.0%.

Mo and W Alone or in Combination in an Amount of (Mo+½W): 0.50 to 3.00%

Mo (molybdenum) and W (tungsten) cause fine carbides to precipitate or aggregate through tempering, thereby providing strength to a cold work tool. Mo and W can be added alone or in combination. An amount of addition can be specified by a Mo equivalent that is defined by a formula (Mo+½W), since an atomic weight of W is approximately twice that of Mo. Of course, only either one of them may be added or both may be added. To achieve the above effects, the amount of addition is not less than 0.50% in terms of the value of (Mo+½W). Preferably, the amount is not less than 0.60%. Since an excessive addition will cause deterioration of machinability and toughness, the amount is not more than 3.00% in terms of the value of (Mo+½W). The amount is preferably not more than 2.00%, more preferably not more than 1.50%, further more preferably not more than 1.00%.

V: 0.10 to 1.50%

V (vanadium) forms carbides and thus has effects of strengthening a matrix and improving wear resistance and resistance to temper softening. Furthermore, vanadium carbides distributed in an annealed structure function as "pinning particles" that suppress coarsening of austenite grains during heating for quenching, and thereby also contribute to improve toughness. To achieve the effects, an amount of addition of V is not less than 0.10%, preferably not less than 0.20%, more preferably not less than 0.40%. Furthermore, in order to act as solid solution carbides (described later) according to the present invention, not less than 0.60% of V may be added. However, since an excessive addition will cause deterioration of machinability as well as deterioration of toughness due to an increase in the carbides, the V content is not more than 1.50%, preferably not more than 1.00%, more preferably not more than 0.90%.

The cold work tool material of the present invention may have the composition including the above elements. A composition may include the above elements and the balance of iron and inevitable impurities. In addition to the above elements, the material may include following elements.

Si: Not More than 2.00%

Si (silicon) is a deoxidizer in a melting process. An excessive addition of Si decreases hardenability. Furthermore, toughness of a cold work tool after quenched and tempered also decreases. Thus, the Si content is preferably not more than 2.00%, more preferably not more than 1.50%, further more preferably not more than 0.80%. On the other hand, Si solid-solves in a structure of the cold work tool, and has an effect of enhancing hardness of the tool. To obtain the effect, an amount of Si is preferable not less than 0.10%, more preferably not less than 0.30%.

Mn: Not More than 1.50%

Excessive addition of Mn (manganese) increases ductility of a matrix, thereby decreasing machinability of the material. Hence, an amount of Mn is preferably not more than 1.50%, more preferably not more than 1.00%, further more preferably not more than 0.70%. On the other hand, since Mn is an austenite-forming element, it has an effect of increasing hardenability. Moreover, Mn has a large effect on improving machinability since it forms a non-metallic inclusion MnS. To achieve the effects, addition of Mn is preferably not less than 0.10%, more preferably not less than 0.20%.

P: Not More than 0.050%

P (phosphorous) is normally included inevitably in various kinds of cold work tool materials, even though it is not added. Phosphorous segregates in prior austenite grain boundaries during a heat treatment such as tempering, thereby making the grain boundaries brittle. Therefore, an amount of phosphorous is limited to not more than 0.050% to improve toughness of the cold work tool, including a case where phosphorous P is added. More preferably, the amount is not more than 0.030%.

S: Not More than 0.0500%

S (sulfur) is normally included inevitably in various kinds of cold work tool materials, even though it is not added. Sulfur deteriorates hot workability of the material before hot working, and produces cracks during the hot working. Therefore, it is preferable to limit an amount of sulfur to not more than 0.050% to improve the hot workability of the material. The sulfur content is more preferably not more than 0.030%, further more preferably less than 0.0100%. On the other hand, sulfur has an effect of improving machinability by bonding with Mn to form a non-metallic inclusion MnS. An amount of more than 0.0300% may be added to achieve the effect.

Ni: Not More than 1.00%

Ni (nickel) increases ductility of a matrix, thereby decreasing machinability. Thus, the Ni content is preferably not more than 1.00%, more preferably less than 0.50%, further more preferably less than 0.30%. The Ni content of less than 0.30% also corresponds to an upper limit of Ni in a case where Ni is included as an impurity.

On the other hand, Ni suppresses generation of ferrite in the tool structure. Moreover, Ni is effective in providing excellent hardenability to the cold work tool material, and enables formation of a structure mainly composed of martensite, even when a cooling rate in quenching is mild, to prevent deterioration of toughness. Furthermore, since Ni also improves intrinsic toughness of the matrix, Ni may be added as needed according to the present invention. In the case of adding Ni, a preferable amount is not less than 0.10% while the upper limit is 1.00%. More preferably, the amount is not less than 0.30%, further more preferably not more than 0.80%.

Nb: Not More than 1.50%

Nb (niobium) causes deterioration of machinability, and an amount of Nb is preferably not more than 1.50%, more preferably not more than 0.90%, further more preferably less than 0.30%. The amount of less than 0.30% of Nb corresponds to an upper limit of Nb in a case where Nb is included as an impurity.

On the other hand, Nb forms carbides and has effects of strengthening a matrix and improving wear resistance. Moreover, Nb increases resistance to temper softening. Nb also has an effect of suppressing coarsening of grains, similarly to V, thereby contributing to improve toughness. Hence, Nb may be added as needed. In the case of adding Nb, an amount is preferably not less than 0.10% while the upper limit is 1.50%. The amount is more preferably not less than 0.30%, further more preferably not more than 1.00%.

Cu, Al, Ca, Mg, O (oxygen) and N (nitrogen) are elements which may possibly remain in a steel as an inevitable impurity. It is preferable to limit an amount of the elements as low as possible in the cold work tool material of the present invention. On the other hand, small amounts of the elements may be added to effectively obtain additional effects such as morphology control of inclusions, or improvements of other mechanical properties and productivity. In the case, following ranges are permissible: Cu≤0.25%; Al≤0.25%; Ca≤0.0100%; Mg≤0.0100%; O≤0.0100%; and N≤0.0300%. These are preferable upper limits of the elements according to the present invention.

(3) The cold work tool material includes a cross sectional region of an annealed structure, the region having a length of 90 μm and a width of 90 μm and including no carbides having a circle equivalent diameter exceeding 5.0 μm, wherein, in the cross sectional region, a proportion of a number of carbides B having a circle equivalent diameter of more than 0.1 μm and not more than 0.4 μm to a number of carbides A having a circle equivalent diameter of more than 0.1 μm and not more than 2.0 μm is greater than 80.0%.

The cold work tool material is typically produced from a raw material of a steel ingot or a bloom (bloomed from the ingot) as a starting material, through various hot working and heat treatment to form a predetermined steel material, and then through annealing process on the steel material, thereby finishing into a block shape. The ingot is typically produced by casting a molten steel that is adjusted to have a predetermined composition. The ingot has a structure including portions where large carbides aggregate and portions where smaller carbides aggregate (so-called "negative segregation" part), due to difference of starting timing of solidification (or due to difference of dendrite growth).

When the ingot is hot worked, the aggregates of carbides are extended along an extending direction of the hot working (that is, a longitudinal direction of the material), and are compressed in a vertical direction thereof (that is, a thickness direction of the material). The hot worked steel is annealed, and the annealed structure of the cold work tool material has a carbides distribution, that is a substantially laminate composed of layers of aggregates of large carbides and layers of aggregates of small carbides (see FIG. 1). In FIG. 1, carbides are seen as "light-colored dispersions" in a dark-colored matrix.

The large carbides in the annealed structure function mainly as "non-solid solution carbides" that are not solid-solved in a matrix during heating for quenching, and remain in the structure after quenching and tempering and thereby contribute to improving the wear resistance of the cold work tool. The small carbides function as "solid solved carbides", that are liable to be solid-solved in the matrix during the heating for quenching. The carbides solid-solved in the matrix increase an amount of solid solved carbon in the matrix after quenching and tempering, and thereby increase hardness of the cold work tool. In the present invention, carbides having a circle equivalent diameter exceeding 5.0 μm in a cross-section of the annealed structure are deemed as non-solid solution carbides, and a region of "a length of 90 μm and a width of 90 μm" including only "solid solution carbides" having a circle equivalent diameter of not more than 5.0 μm is noted (for example, see a portion surrounded by a solid line in FIG. 1). That is, the region of "a length of 90 μm and a width of 90 μm" corresponds to a region of a "layer of aggregates of small carbides". It was discovered that the carbide distribution in this region can be utilized for the "hardness stability effect" of the present invention.

The inventors investigated an influence of the carbides having a circle equivalent diameter of not more than 5.0 μm on hardness of the cold work tool after quenched and tempered. As a result, they found that, among such carbides, carbides having a further smaller circle equivalent diameter of "not more than 2.0 μm" (hereunder, referred to as "carbides A") are more liable to be solid-solved. They also found that, extremely fine carbides having a circle equivalent diameter of "not more than 0.4 μm" (hereunder, referred to as "carbides B") are particularly liable to be solid-solved. They further found that the small carbides can be uniformly distributed in the annealed structure by manipulating a casting process or the like when producing the steel ingot. When carbides liable to be solid-solved are distributed, in particular uniformly, in the annealed structure, an amount of solid solution carbon in the structure of the cold work tool after quenched and tempered can be increased overall uniformly. As a result, an absolute value of the hardness can be increased, and even if the tempering temperature is changed, a high hardness can be maintained.

Therefore, it is effective for obtaining the "hardness stability effect" of the present invention to increase a number of carbides having a circle equivalent diameter of not more than 0.4 μm among a number of carbides having a circle equivalent diameter of not more than 2.0 μm in a region that does not include carbides having a circle equivalent diameter exceeding 5.0 μm. According to the present invention, the "hardness stability effect" can be achieved by a structure in which, a proportion of a number of carbides B having a circle equivalent diameter of more than 0.1 μm and not more than 0.4 μm to a number of carbides A having a circle equivalent diameter of more than 0.1 μm and not more than 2.0 μm, is more than 80.0% in the region of a length of 90 μm and a width of 90 μm. The lower limit of the circle equivalent diameter of both carbides A and B is defined to be 0.1 μm since the carbides having a circle equivalent diameter of not more than 0.1 μm can not be measured with accuracy.

The proportion of the number of carbides B to the number of carbides A is preferably not less than 81.0%, and more preferably not less than 82.0%. Further preferably, the proportion is not less than 83.0%. While an upper limit of the proportion is not required particularly, the proportion will be realistically not more than 95.0%.

(4) Preferably, a number density of the carbides A is not less than $9.0\times10^5$ per $mm^2$, and a number density of the carbides B is not less than $7.5\times10^5$ per $mm^2$ in the above region of a length of 90 μm and a width of 90 μm.

With respect to the above item (3), it is more advantageous for achieving the "hardness stability effect" of the present invention to include greater number of the fine carbides A and B distributed in the region that does not includes carbides having a circle equivalent diameter exceeding 5.0 μm. Furthermore, with respect to the carbides A and B, it is preferable to make a number density of the carbides A not less than $9.0\times10^5$ per $mm^2$ or a number density of the carbides B not less than $7.5\times10^5$ per $mm^2$. More preferably, both of the carbides A and the carbides B satisfy the above respective number densities.

The number density of the carbides A is more preferably not less than $9.5\times10^5$ per $mm^2$, further more preferably not less than $10.0\times10^5$ per $mm^2$. Particularly preferably, the number density is not less than $11.0\times10^5$ per $mm^2$. The number density of the carbides B is more preferably not less than $8.0\times10^5$ per $mm^2$, further more preferably not less than $8.5\times10^5$ per $mm^2$. Particularly preferably, the number density is not less than $9.0\times10^5$ per $mm^2$. Please note that the number density of the carbides B does not exceed the number density of the carbides A. Although upper limits of the number densities of the carbides A and carbides B are not particularly required, a relation such that the proportion is not more than 95.0% is realistic.

Here, an example of a method for measuring the circle equivalent diameter and the number (number density) of the carbides A and B is described below.

First, a cross-sectional structure of the cold work tool material is observed with an optical microscope with a magnification of 200 times, for example. The observed cross section may be taken from a center portion of a cold work tool material for the cold work tool. The cross-section to be observed is parallel to an extending direction of the hot working (that is, a longitudinal direction of the material), specifically, a cross-section (so-called "TD cross-section") that is perpendicular to a TD direction (transverse direction) among the above parallel cross-section. This cross-section having an area of 15 mm×15 mm for example can be polished to a mirror surface by means of a diamond slurry and colloidal silica. FIG. 1 shows an optical microscope photograph (field-of-view area: 0.58 $mm^2$) at a magnification of 200 times of a cross-sectional structure obtained with the above procedures for an example of the cold work tool material of the present invention (that is, "cold work tool material 1" as an example of the present invention in the Examples).

Then, a region of a length of 90 μm and a width of 90 μm that does not include carbides having a circle equivalent diameter exceeding 5.0 μm is selected from the cross-sectional structure. At this time, large carbides having a circle equivalent diameter exceeding 5.0 can be easily observed from the field of view of the optical microscope (see FIG. 1). The circle equivalent diameter of the observed carbides can be determined by means of known image analysis software or the like.

Next, the selected region having a length of 90 μm and a width of 90 μm (see a portion surrounded by a solid line in FIG. 1) is observed with a scanning electron microscope (magnification of 3000 times), and the observed field is analyzed with an EPMA to obtain an elemental mapping image of C (carbon). Subsequently, a binarizing process is conducted with a threshold of not less than 25 counts (cps) of a detected intensity of carbon on an analysis result of the elemental mapping image of carbon, based on an amount of carbon forming carbides. Thus, a binary image showing carbides that are distributed in the matrix of the cross-sectional structure is obtained.

Figure 2:
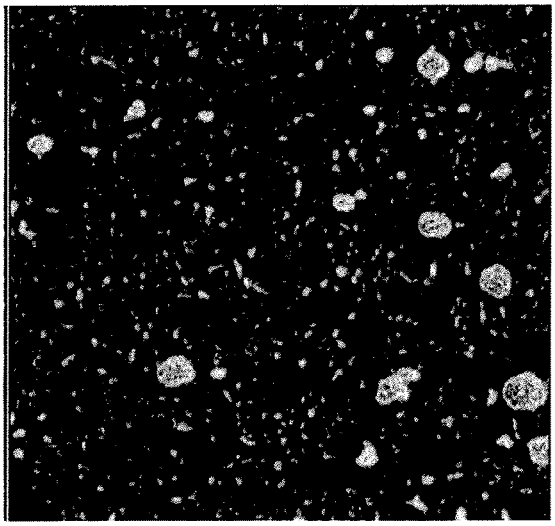
FIG. 2 is a view illustrating an elemental mapping image of C (carbon) of a region that does not include carbides having a circle equivalent diameter exceeding 5.0 μm when analyzed by means of an EPMA (electron probe microanalyzer), for an example of a cross-sectional structure of the cold work tool material of the present invention.
Figure 3:
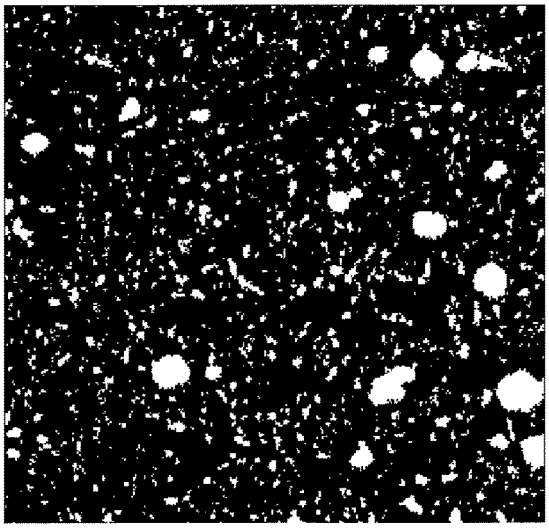
FIG. 3 is a view illustrating a binary image of FIG. 2 based on an amount of carbon that forms carbides.

FIG. 2 shows an elemental mapping image of carbon (field-of-view area: 30 μm×30 μm) obtained by the above procedures for the region surrounded by a solid line in FIG. 1. FIG. 3 is a view illustrating a carbide distribution in the region, which is obtained by the binarizing process for FIG. 2. In FIGS. 2 and 3, carbon and carbides are shown with a light-colored distribution.

From the carbide distribution in FIG. 3 that "does not include carbides having a circle equivalent diameter exceeding 5.0 μm", carbides having respective circle equivalent diameters can be counted, and thus the above numbers of carbides A and B as well as the proportion between the numbers of carbides A and B can be determined. The circle equivalent diameters and the numbers of the carbides can be determined by means of known image analysis software or the like.

In the case of the cold work tool material of the present invention, small carbides having a circle equivalent diameter of not more than 2.0 μm are distributed with a substantially uniform number density (see FIG. 3) in a region of the length of 90 μm and width of 90 μm in "a layer of aggregates of small carbides". Thus, only a single elemental mapping image with an area of 30 μm×30 μm (number of pixels: 530×530) is sufficient for confirming the "hardness stability effect" of the present invention, when the image is selected from the above described region having a length of 90 μm and a width of 90 μm. Furthermore, a position of the elemental mapping image may be arbitrarily selected from the above region. If the series of measurement is conducted for at least two other regions having "a length of 90 μm and a width of 90 μm" separate from the above region having "a length of 90 μm and a width of 90 μm" (that is, a total of three regions) and averaging the numerical results, the "hardness stability effect" of the present invention can be sufficiently confirmed.

The annealed structure of the cold work tool material of the present invention can be obtained by appropriately controlling a solidification process in a step of producing a steel ingot as the starting material. For example, it is important to adjust a "temperature of a molten steel" immediately prior to pouring it in a casting mold. A temperature of the molten steel is controlled at a lower temperature, for example, in a temperature range up to a temperature of a melting point of the cold work tool material + around 100° C. Thereby, local concentration of the constituents in the molten steel due to differences between solidification starting timing at different positions in the mold can be reduced, and coarsening of carbides that is caused by growth of dendrite can be suppressed. Furthermore, for example, the molten steel cast in the mold is cooled so that it quickly passes a solid-liquid coexisting temperature zone, for example, by cooling within 60 minutes. Thereby, coarsening of crystallized carbides can be suppressed.

(5) A method of manufacturing a cold work tool, comprising a step of quenching and tempering the above cold work tool material The above cold work tool material of the present invention is adjusted to have a martensitic structure having a predetermined hardness by quenching and tempering, and made into a cold work tool product. The cold work tool material is made into a shape of the cold work tool by various machining such as cutting, boring or the like. This machining is preferably conducted when the hardness of the material is low (that is, in an annealed state) before quenched and tempered. In this case, finishing machining may be further conducted after quenched and tempered. Alternatively, in some cases, a material in a state of pre-hardened steel which has been subjected to performing quenching and tempering may be machined into a shape of a cold work tool together with the finishing machining.

Temperatures of the quenching and the tempering differs depending on compositions of the material or target hardness or the like. Preferably, the quenching temperature is approximately 950 to 1100° C., and the tempering temperature is approximately 150 to 600° C. In a case of SKD10 or SKD11 for example, which are representative steel grades of cold work tool steels, the quenching temperature is approximately 1000 to 1050° C. and the tempering temperature is approximately 180 to 540° C. A hardness of the quenched and tempered material is preferably not less than 58 HRC, and more preferably not less than 60 HRC. While an upper limit of the quenching and tempering hardness is not particularly defined, a hardness of not more than 66 HRC is realistic.

EXAMPLES

A molten steel having a melting point of approximately 1400° C., that had been adjusted to a predetermined composition, was cast to produce raw materials 1 to 4 having a composition shown in Table 1 A temperature of each molten steel for the raw materials 1 to 4 was adjusted to 1500° C. before pouring in a casting mold. Dimensions of the casting molds for respective raw materials 1 to 4 were changed therebetween. Thus, cooling time period passing a solid-liquid coexisting temperature zone after the pouring was adjusted as follows, Material 1: 28 minutes, Material 2: 45 minutes, Material 3: 106 minutes, and Material 4: 168 minutes. The materials 1 to 4 correspond to a cold work tool steel SKD10 that is a standard steel grade of JIS-G-4404.

TABLE 1

| C | Si | Mn | P | S | Cr | Mo | V | mass % Fe[x] |
|---|---|---|---|---|---|---|---|---|
| 1.48 | 0.53 | 0.42 | 0.022 | 0.0002 | 11.9 | 0.76 | 0.74 | Bal. |

[x]including impurities

Next, these raw materials were heated to 1160° C. and hot worked. After the hot working, the raw materials were stood to cool. Thus, steel materials having a thickness of 25 mm, a width of 500 mm and a length of 100 mm were obtained. The materials were subjected to annealing at 860° C. to obtain cold work tool materials 1 to 4 having a hardness of 190 HBW.

A sample having a cross sectional area of 15 mm×15 mm was cut out from a TD face at a center portion of each cold work tool material 1 to 4, which cross section was parallel to a extending direction of the hot working (that is, a longitudinal; direction of the material). Then, the section was polished to a mirror surface with use of a diamond slurry and colloidal silica. Next, three regions having a length of 90 μm and a width of 90 μm and including no carbides having a circle equivalent diameter exceeding 5.0 μm were selected from an annealed structure of each polished section. FIG. 1 shows an example of the region in the cold work tool material 1 (see a portion surrounded by a solid line).

For each region, a number of carbides A having a circle equivalent diameter more than 0.1 μm and not more than 2.0 μm, a number of carbides B having a circle equivalent diameter more than 0.1 μm and not more than 0.4 μm, and a proportion of the number of carbides B to the number of carbides A were determined in accordance with the above described means. An open source image processing software program "Image J" (http://imageJ.nih.gov/ij/) supplied from the National Institutes of Health (NIH) was used for image processing and analysis for determining the circle equivalent diameter and the number of the carbides. FIG. 2 illustrates an elemental mapping image of carbon in the region of the cold work tool material 1. A field-of-view area in FIG. 2 is 30 μm×30 μm. This field of view is a center section of nine sections when the region with a length of 90 μm and a width of 90 μm was divided into the nine sections by trisecting the length and the width respectively. FIG. 3 shows a binary image for the elemental mapping image in FIG. 2 with a threshold of a detected intensity of carbon of 25 counts (cps).

Figure 4:
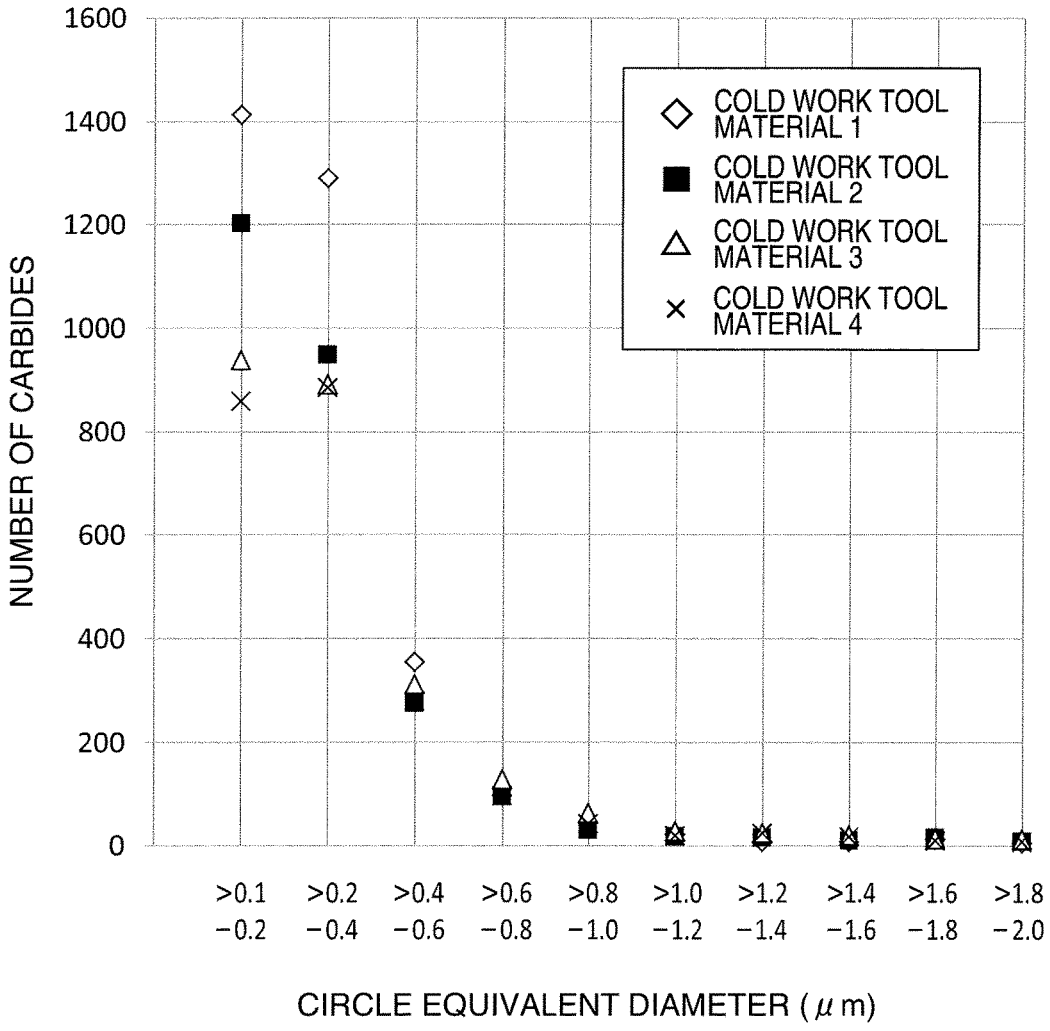
FIG. 4 is a graph illustrating a number of carbides (in axis of ordinate) in relation to each range of circle equivalent diameter of carbides (in abscissa axis) with respect to distributed carbides in a region that does not include carbides having a circle equivalent diameter exceeding 5.0 μm, for an example of a cross-sectional structure of cold work tool material according to examples of the present invention and comparative examples

The measured numbers of carbides A and B in respective regions were averaged to determine the numbers of carbides A and B for the cold work tool materials 1 to 4. The number densities of the carbides A and B and the number proportions between the carbides A and B were determined from the values. The results are shown in Table 2. FIG. 4 is a view plotting the numbers of carbides in the cold work tool materials 1 to 4 (in axis of ordinate) that were determined by the averaging of three regions in relation to ranges of the circle equivalent diameter of the carbides (in abscissa axis). "Carbides having a circle equivalent diameter exceeding 5.0 μm" were not included in the regions of the cold work tool materials 1 to 4.

TABLE 2

| Cold work tool material | Number density (per mm$^2$) Carbides A | Carbides B | Proportion of number of carbides B to number of carbides A (%) | Remarks |
|---|---|---|---|---|
| 1 | $12.0 \times 10^5$ | $10.0 \times 10^5$ | 83.3 | Examples of the invention |
| 2 | $9.7 \times 10^5$ | $8.0 \times 10^5$ | 82.5 | |
| 3 | $9.0 \times 10^5$ | $6.8 \times 10^5$ | 75.6 | Comparative examples |
| 4 | $8.3 \times 10^5$ | $6.5 \times 10^5$ | 78.3 | |

After the cross-sectional structures were observed, the cold work tool materials 1 to 4 were subjected to quenching from 1030° C., followed by tempering at a temperature of 100 to 540° C. to obtain cold work tools 1 to 4 having a martensitic structure. A total of 10 conditions were adopted for the tempering temperatures, namely, low-temperature tempering conditions of 100° C., 150° C., 200° C. and 300° C., and high-temperature tempering conditions of 450° C., 480° C., 490° C., 500° C., 520° C. and 540° C. Subsequently, Rockwell hardness tests (C scale) were conducted at positions including the observed cross-sectional structures for each tempering temperature sample of each cold work tool 1 to 4. The hardness was measured at five points for each sample, and an average thereof was determined. The hardness as well as dependence of the hardness on the tempering temperature (stability of the hardness) was evaluated. The results are shown in FIG. 5 for low-temperature tempering conditions and FIG. 6 for high-temperature tempering conditions.

Figure 5:
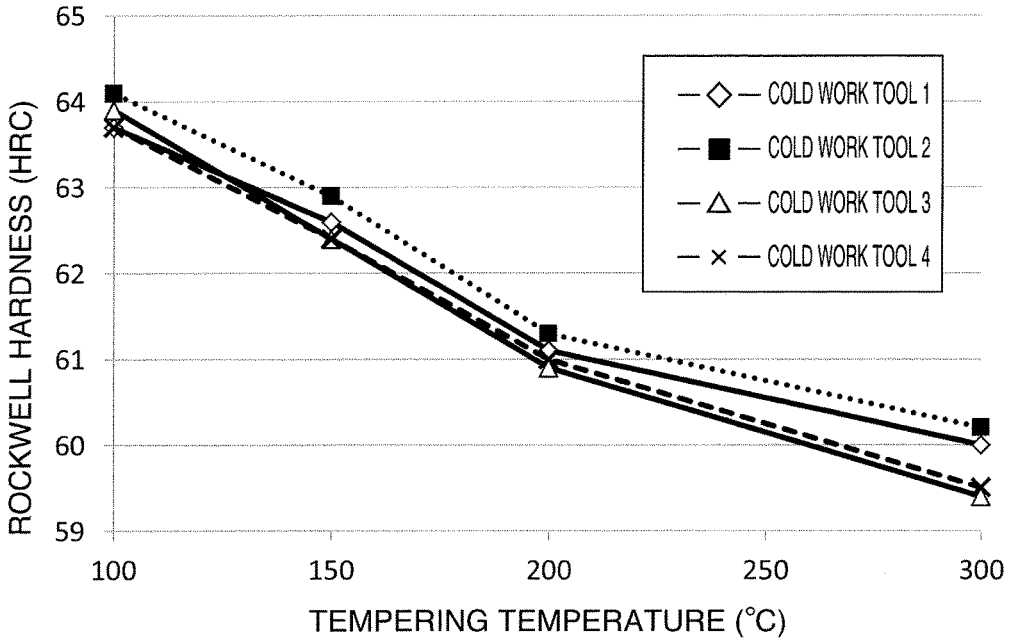
FIG. 5 is a graph showing hardness in relation to tempering temperatures of an example of a cold work tool tempered at low temperatures (100 to 300° C.) after quenched for the examples of the present invention and the comparative examples.
Figure 6:
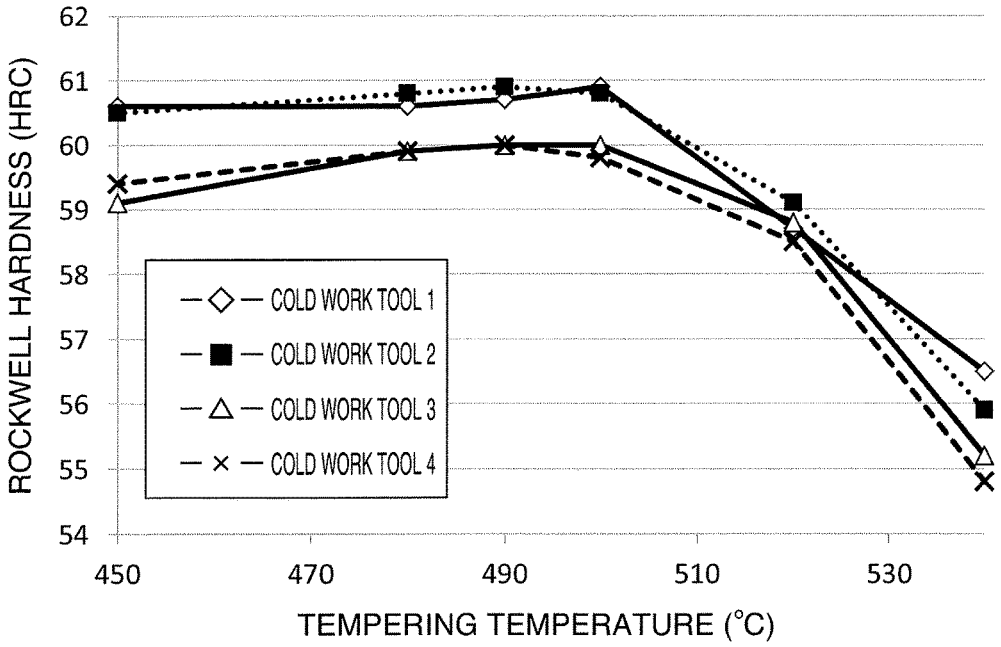
FIG. 6 is a graph showing hardness in relation to tempering temperatures of an example of a cold work tool tempered at high temperatures (450 to 540° C.) after quenched for the examples of the present invention and the comparative examples.

It is seen from FIGS. 5 and 6 that the hardness of the cold work tools 1 and 2 according to the present invention was higher, over a wide temperature range, than the cold work tools 3 and 4 of the comparative examples in both cases of low-temperature tempering (100 to 300° C.) and high-temperature tempering (450 to 540° C.). Particularly in the case of the high-temperature tempering, the cold work tools 1 and 2 according to the invention could achieve high hardness of not less than 60 HRC that is required for a cold work tool in a wide range of tempering temperature of 450 to 510° C., while the cold work tools 3 and 4 of the comparative examples could obtain it only at tempering temperatures around 490° C. Furthermore, the cold work tools 1 and 2 could achieve the high hardness of not less than 60 HRC at two conditions of the tempering temperature 200° C. and 500° C. that are standard tempering temperatures for the cold work tool steel SKD10.

The invention claimed is:

1. A cold work tool material used after quenched and tempered, having an annealed structure including carbides, wherein the cold work tool material has a composition including, in mass %, C: 0.80% to 2.40%, Cr: 5.0% to 15.0%, Mo and W alone or in combination in an amount of (Mo+½W): 0.50% to 3.00%, and V: 0.10 to 1.50%, the composition being adjusted such that the material has a martensitic structure by the quenching, wherein the cold work tool material includes a cross sectional region of an annealed structure, the region having a length of 90 μm and a width of 90 μm and including no carbides having a circle equivalent diameter exceeding 5.0 μm, wherein, in the cross sectional region, a proportion of a number of carbides B having a circle equivalent diameter of more than 0.1 μm and not more than 0.4 μm to a number of carbides A having a circle equivalent diameter of more than 0.1 μm and not more than 2.0 μm is greater than 80.0%, and wherein the cold work tool material is produced by casting an ingot and hot working the ingot.

2. A method of manufacturing a cold work tool, comprising a step of quenching and tempering the cold work tool material according to claim 1.

3. The cold work tool material according to claim 1, wherein, in the cross sectional region, a number density of the carbides A is not less than $9.0\times10^5$ per $mm^2$, and a number density of the carbides B is not less than $7.5\times10^5$ per $mm^2$.

4. A method of manufacturing a cold work tool, comprising a step of quenching and tempering the cold work tool material according to claim 3.

* * * * *